United States Patent [19]

Widmyer

[11] 4,034,812

[45] July 12, 1977

[54] METHOD FOR RECOVERING VISCOUS PETROLEUM FROM UNCONSOLIDATED MINERAL FORMATIONS

[75] Inventor: Richard H. Widmyer, Houston, Tex.

[73] Assignee: Texaco Inc., New York, N.Y.

[21] Appl. No.: 599,563

[22] Filed: July 28, 1975

[51] Int. Cl.[2] ..... E21B 43/22; E21B 43/24

[52] U.S. Cl. ..... 166/303; 166/305 R; 166/306

[58] Field of Search ..... 166/303, 302, 305 R, 166/269, 272, 306

[56] References Cited

U.S. PATENT DOCUMENTS

| | | | |
|---|---|---|---|
| 2,862,558 | 12/1958 | Dixon | 166/272 |
| 3,057,404 | 10/1962 | Bergstrom | 166/302 X |
| 3,118,499 | 1/1964 | Johnson et al. | 166/269 X |
| 3,199,586 | 8/1965 | Henderson et al. | 166/275 X |
| 3,221,813 | 12/1965 | Closmann et al. | 166/272 X |
| 3,251,412 | 5/1966 | Cooke, Jr. et al. | 166/305 R X |
| 3,401,748 | 9/1968 | Statton | 166/275 X |
| 3,459,265 | 8/1969 | Buxton et al. | 166/272 X |
| 3,500,916 | 3/1970 | van der Knaap et al. | 166/272 |
| 3,500,917 | 3/1970 | Lehner et al. | 166/272 |
| 3,858,654 | 1/1975 | Walker | 166/303 X |

FOREIGN PATENT DOCUMENTS

| | | | |
|---|---|---|---|
| 1,112,956 | 5/1968 | United Kingdom | 166/272 |

*Primary Examiner*—Stephen J. Novosad
*Assistant Examiner*—George A. Suchfield
*Attorney, Agent, or Firm*—Carl G. Ries; Thomas H. Whaley; Jack H. Park

[57] ABSTRACT

Disclosed is a method whereby viscous petroleum may be recovered from a subterranean viscous petroleum-containing formation in which the formation mineral matrix is substantially unconsolidated, such as a tar sand deposit. A hot fluid such as steam is injected into the formation and pressure maintained thereon for a period of time to heat the viscous petroleum in the immediate vicinity of the well bore, which causes the unconsolidated mineral grains to settle to the bottom of the formation with the viscous oil located on the top of the settled grains. The injection pressure maintenance phase is then terminated and petroleum is recovered from the upper portion of the formation. Numerous cycles of hot fluid injection, soak, followed by production of petroleum from the upper portion of the cavity are required to exploit a reasonable aerial extent of the formation by this method. The separation is enhanced by introducing a solvent material for the viscous petroleum which has a specific gravity substantially less than the specific gravity of petroleums, such as a low molecular weight hydrocarbon solvent, or introducing a fluid which is immiscible with petroleum and which has specific gravity substantially greater than the specific gravity of the viscous petroleum, such as a dense brine which settles to the bottom portion of the cavity and displaces petroleum upward. Both treatments may be employed simultaneously for optimum recovery.

20 Claims, 1 Drawing Figure

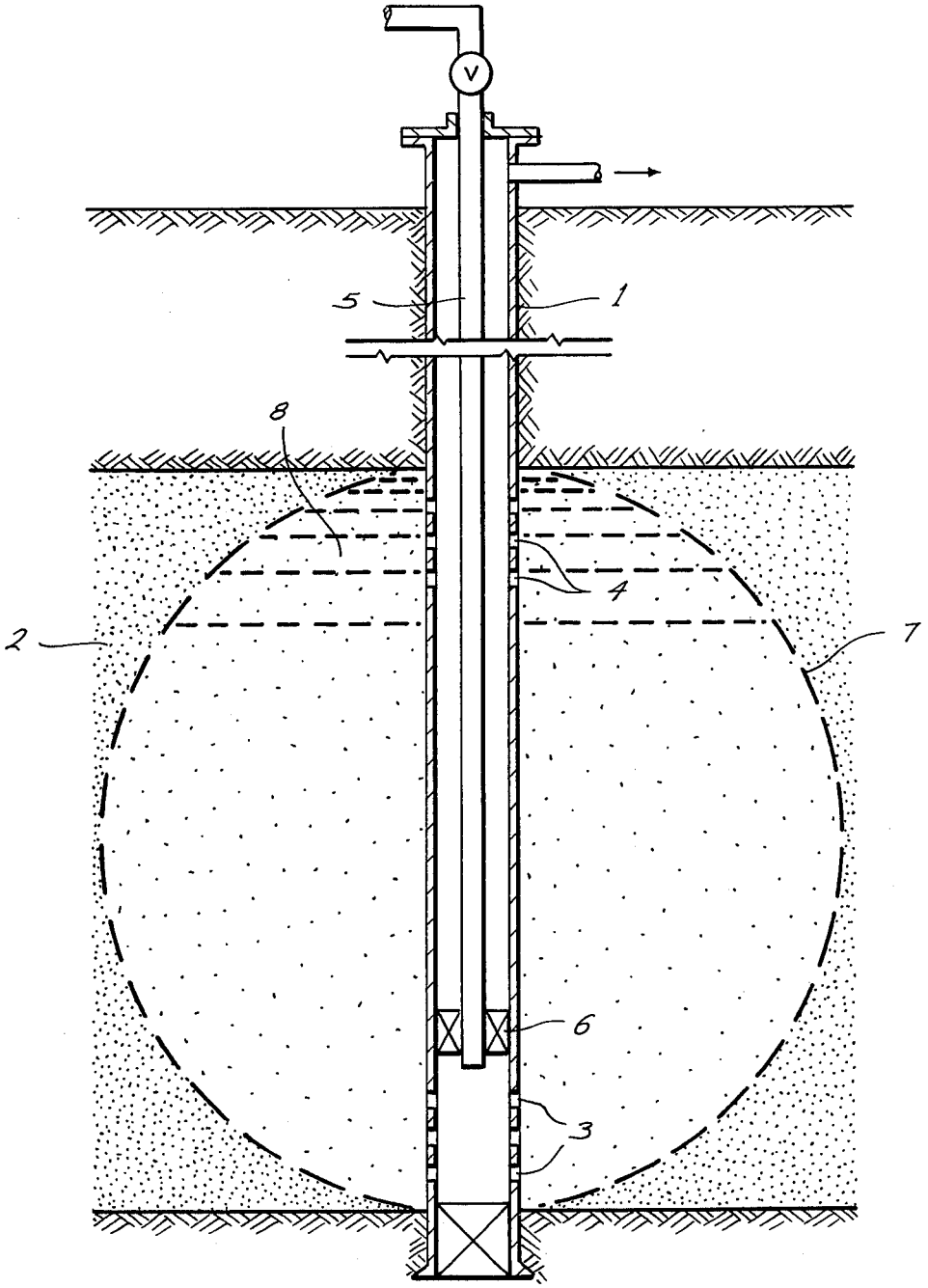
V
5
1
8
4
2
7
6
3

METHOD FOR RECOVERING VISCOUS PETROLEUM FROM UNCONSOLIDATED MINERAL FORMATIONS

BACKGROUND OF THE INVENTION

1. Field of the Invention

This invention concerns a method for recovering viscous petroleum from a subterranean, viscous petroleum-containing formation in which the mineral content of the formation is substantially unconsolidated, such as the unconsolidated tar sand deposits.

2. Description of the Prior Art

There are many subterranean petroleum-containing formations in various parts of the world from which petroleum cannot be recovered by conventional means because the petroleum is too viscous to flow or be pumped. The most extreme example of such viscous petroleum-containing formations are the so called tar sand or bituminous sand deposits such as those located in numerous western states in the United States and in Alberta, Canada, as well as in Venezuela. Other smaller deposits exist in Europe and Asia.

Tar sands are generally defined as sand saturated with a highly viscous crude petroleum material not recoverable in its natural state through a well by ordinary production methods. The petroleum constituent of tar sand deposits is highly bituminous in character and the viscosity at normal formation temperatures of about 50° F is in the range of a million centistokes. While this is a very high viscosity, the viscosity-temperature relationship is exceedingly sharp, and the viscosity drops to about 20 centistokes at a temperature of about 300° F. The sand present in tar sand deposits is generally fine quartz sand, in many cases waterwet and the bituminous petroleum material occupies most of the void space around the water-wet sand grains. The balance of the void space is filled with connate water, with some deposits containing small volumes of gas such as air or methane. Even in those formations in which the sand grains are in contact, the void volume of the formation is about 35% by volume with the balance of the void space being filled with water and bituminous petroleum. The specific gravity of bituminous petroleum found in tar sand deposits is about 1.0 which further complicates the separation by many processes since bituminous petroleum may be lighter than water or denser than water or they may have essentially the same density.

Methods proposed and evaluated for recovering bituminous petroleum from unconsolidated sand formations includes strip mining and in situ separation processes. Strip mining is feasible only in those deposits located relatively close to the surface of the earth, and in situ separation processes have generally not been technically and/or economically successful. Among the various in situ separation processes described in the literature are thermal techniques such as fire flooding or in situ combustion and steam flooding, as well as emulsification drive processes which may also utilize steam. Solvent flooding is also feasible, but losses of solvent to a formation in a conventional throughput process are high and thus solvent processes have not been economically viable up to the present time.

Besides the usually high viscosity of bituminous petroleum found in tar sand deposits, other problems are encountered in processes for in situ separation of viscous petroleum from the sand grains. If a substantial amount of the sand is produced to the surface of the earth, disposal of the sand becomes a difficult problem. The production of abnormal amounts of sand in conventional well is detrimental to continued production of petroleum therefrom, and sand control methods which are applicable in conventional oil sands are not especially suitable for use in in situ separation processes applied to tar sand deposits because of the high temperatures frequently involved in in situ separations, as well as the fine grain sands generally encountered in tar sand deposits.

It can be seen from the foregoing that there is a substantial need for a method for recovering viscous petroleum from a subterranean, unconsolidated sand or other mineral formation whereby most of the sand is left in the formation and the petroleum is selectively removed from the formation.

SUMMARY OF THE INVENTION

I have discovered, and this constitutes my invention, that viscous petroleum including bituminous petroleum may be recovered from viscous petroleum-containing, unconsolidated mineral formations including tar sand deposits by a systematic program of hot fluid injection and pressurization and petroleum production variance so as to improve the heat penetration into the formation, and permit sand settling within the reservoir, with petroleum separating into a zone separate from and above the settled sand, so that essentially sand free viscous petroleum may be recovered. The method may be accomplished in a single well or in a number of wells, but at least in the initial phases it is not a throughput process but rather a process in which fluid injection and petroleum production are both accomplished in the same well by means of a cyclic procedure. The first step involves injection of a hot fluid such as steam into the formation and maintaining the pressure of the hot fluid sufficiently high to encourage maximum penetration of the hot fluid into the oil containing, unconsolidated mineral formation. A soak period is then utilized to permit the maximum settling of the unconsolidated mineral granules to the bottom of the formation, at which time the viscous petroleum accumulates in a layer or pool above the setled mineral grains. Pressure may then be reduced and viscous petroleum removed from the formation at the point where it has accumulated. Once the petroleum production phase is completed, the introduction of hot fluid may be reinitiated and many cycles of hot fluid injection, followed by a soak period to permit sand settling followed by petroleum production are usually required. Introduction of a fluid which is immiscible with the viscous petroleum and which has a specific gravity greater than the specific gravity of the viscous petroleum will aid in separation of the viscous petroleum from the settled sand grains, since the higher specific gravity fluid will occupy the void spaces between the settled mineral grains, displacing the viscous petroleum upward. A surface-tension reducing agent may be incorporated in the dense, oil-immiscible fluid to aid in dislodging petroleum from the mineral grains. A solvent or fluid miscible with the viscous petroleum which has a specific gravity substantially less than the specific gravity of the viscous petroleum may also be introduced into the formation. This aids in separation since the mixture of petroleum and solvent will have a specific gravity less than the specific gravity of the petroleum prior to being contacted with the solvent. The oil-depleted zone created in the portion of the formation contacted by the heated fluid will increasse with continuation of multiple cycles of this process, and so greater quantities of fluid will be required prior to the termination of each cycle.

DESCRIPTION OF THE PREFERRED EMBODIMENTS

The process of my invention comprises a cyclical, single well bore treatment applicable to subterranean, viscous petroleum-containing formations in which the mineral portion of the formation is substantially unconsolidated. It is especially applicable to the very thick formations which are difficult to exploit in a sufficient manner by throughput or other conventional oil recovery methods. It is also especially applicable to formations in which the sand or other granular minerals present in the formation are discontinuous or are essentially suspended in and supported by the viscous petroleum. These are the formations in which the most difficulty is experienced during the course of oil production because of production of excessive sand along with the formation petroleum in the producing well, which causes the well to "sand up" and necessitates termination of oil production activities while the well is cleaned out.

The first step of the process of my invention involves injecting a hot fluid into the formation for the purpose of increasing the temperature of the viscous petroleum contained therein so as to reduce its viscosity. The temperature of the hot fluid should be greater than the formation temperature and sufficient to decrease the viscosity of the formation petroleum appreciably. Usually a temperature greater than 150° F (65.5° C) and preferably greater than 250° F (121.1° C) is required. The flow of any fluid away from an injection well or into a production well is primarily influenced by the following relationship:

$$Q = \frac{Kh\Delta P}{\mu \ln r_{e/r_w}} = \frac{K}{\mu} \frac{h\Delta P}{\ln r_{e/r_w}}$$

wherein $Q$ = flow rate $K$ = permeability $h$ = thickness involved or affected $\Delta P$ = pressure differential between the well bore and the formation.

$\mu$ = viscosity of the injected fluid at the temperature involved $r_e$ = radius of application of the pressure $r_w$ = the radius of the well bore.

The ratio of the function $K$ to $\mu$, wherein K represents permeability and $\mu$ represents formation fluid viscosity, is usually low in the type of formations to which the present process will be applied, and some preliminary treatments such as gas injection for the purpose of opening up the permeability of the formation may be necessary prior to the injection of steam or other heated fluid material.

The thickness of the formation treated, h, will depend upon the amount of formation available which can be affected by the heat introduction.

The pressure differential Δ P, is limited not only by the equipment available but also by the maximum pressure which can be applied to a particular formation without lifting or fracturing the overburden. Ordinarily, the thickness of the overburden expressed in feet is approximately the maximum pressure in pounds per square inch which can be applied to a formation without danger of rupturing the overlying formation. The viscosity of the viscous petroleum will be reduced by the application of heat thereto, and so its flow rate into the production well, which is influenced by the same factors discussed above, will be greatly increased. The viscosity of the injected fluid will ordinarily be very much less than the viscosity of the viscous petroleum, so the viscosity of the injected fluid is not a limiting factor on injection rate or penetration depth in the formation.

The radius which is affected by the injected heated fluid, which is equivalent to radius of drainage in the case of a production well, is primarily influenced by the extent which the heated fluid can penetrate the relatively low permeability formation, as well as by the conductive heat flow from the zone adjacent the well outward in to the formation.

The effective well bore radius $r_w$, is an essentially unchangable parameter in conventional oil recovery operations, i.e., when a well is drilled into a rock matrix, but in the present process $r_w$ will expand with each cycle of the process of my invention since the application of this process effectively creates a cavity or treated zone equivalent to a greatly enlarged well bore. As the cavity increases, the effectiveness of the process is also increased since the surface area exposed will be increased in a similar way.

In the first step of the process of my invention, the heated fluid is injected into the formation and the pressure gradually increased until the pressure limit imposed by the overburden rule discussed above is reached. Injecting the fluid until the maximum desired pressure is achieved is desirable for several reasons. The maximum penetration of the heated fluid through the low permeability formation will be achieved when the maximum pressure differentially exist, and that will result from the maximum tolerable injection pressure. Also, the temperature of the heated fluid is a function of pressure.

Although other completion techniques could be used, the well completion illustrated in the attached FIGURE is a particularly desirable one for application of the process of the present invention to a thick, viscous oil, unconsolidated sand formation. Well 1 penetrates viscous petroleum formation 2 and has perforations or other communication means located at 3 near the bottom of the formation and 4 near upper portion of the formation. An injection-production tubing string 5 is concentrically positioned in the casing of well 1 and terminated above the bottom of formation 2. A packer 6 isolates the annular space between the tubing 5 and casing of well 1. Steam is injected into the formation via either the top perforations 4 or the bottom perforations 3, or it may be injected simultaneously through both perforations. In many type formations, one method of establishing the initial permeability involves injection of steam into one set of perforations, such as for example, perforations 4 in the upper portion of the formation, and recovering steam and other fluids via the other set of perforations such as perforations 3 in the lower part of the formation. This would be necessary only in the very early stages of the first injection cycle, and it is preferably to inject the heated fluid via both perforations as soon as it becomes practical to do so. As the permeable void space adjacent the perforations is saturated with the injected heating fluid, the injection pressure will tend to rise and once the injection pressure rises to the predetermined maximum allowable pressure as determined either by equipment limitations or by the overburden thickness, injection of fluid is stopped. The injection of fluid may be terminated altogether, but preferably pressure is maintained with only as much fluid injected as is necessary to maintain the bottom hole injection pressure constant.

It is desirable to leave the heated fluid in the formation for a period time, i.e., a soak period, in order to achieve the desired heating of the formation petroleum. Sand settling will begin as soon as the heated fluid has entered the formation and the viscous petroleum temperature has been increased to a point to where its viscosity begins decreasing sufficient to permit the sand to settle.

In those formations in which the sand content is comparatively low and it is in effect suspended in the viscous petroleum, settling will occur with no additional treatment being necessary. In some formations, the viscous petroleum occupies the void space between sand grains which are in grain-to-grain contact even though there is no cementing of the grains to form a consolidated matrix. In this case little or no sand settling will occur and it will be necessary to apply a supplemental technique in order to separate the bituminous petroleum and encourage it to accumulate in the upper portion of the formation adjacent the well bore so it may be recovered.

One method for causing the separation of viscous petroleum from sand is to inject a fluid, preferably heated to avoid cooling the viscous petroleum which fluid is immiscible with petroleum, into the formation, and which fluid has a specific gravity greater than specific gravity of the petroleum at the temperature to which the petroleum has been heated by virtue of introducing the heated fluid. Water having dissolved therein an adequate amount of an inorganic salt such as sodium chloride or calcium chloride to increase its specific gravity to a value at least 5% and preferably 20 percent greater than the specific gravity of the viscous petroleum at its increased temperature is a particularly desirable fluid to use for this purpose. In application of the process of my invention to a well according to the completion technique illustrated in the attached figure, a convenient method for introducing this fluid into the formation would be to pump it into the well by means of tubing 5, which directs the fluid into the lower portions of the formation. Sufficient fluid is introduced to saturate the sand portion of the formation in the lower part of the formation, which fills the affected area and displaces petroleum upward into the upper portion of the affected area which is designated by dotted line 7. The viscous petroleum which has been separated from the sand in the lower portion of the cavity accumulates in zone 8 in the upper portion of the affected area. Production may be taken through perforations in casing 1 and then through the annular space to the surface of the earth. A surfactant may also be incorporated in the brine, to improve the efficiency in separating viscous petroleum from the sand grains. The surfactant must be one which is stable in high salinity and high temperature, however.

Another method for increasing the separation efficiency and/or sand settling is to introduce an oil soluble material into the formation either simultaneously with the introduction thereinto of the heated fluid or after the introduction of heated fluid has been accomplished and some separation has already begun, which fluid is less dense than the formation petroleum and is miscible with the formation petroleum and immiscible with the aqueous formation fluid present in the settled sand or fluid which was introduced into the sand for the purpose of displacing petroleum upward. A suitable material for this purpose would be a low molecular weight aliphatic hydrocarbon solvent, e.g. $C_3$ to $C_{10}$ hydrocarbon. The low molecular weight hydrocarbon would dissolve in the viscous petroleum, thereby enhancing the viscosity reduction effect and simultaneously reducing the specific gravity of the petroleum so as to encourage its movement to the upper portion of the affected area. Other solvents such as carbon dioxide may be utilized. Dense solvents such as carbon disulfide or carbon tetrachloride, as well as solvents having specific gravity similar to viscous petroleum's specific gravity such as benzene, toluene, etc. should not be utilized if it is desired to force the petroleum to accumulate in a zone above the sand.

Once the petroleum which has accumulated in the upper portion of the affected area has been recovered therefrom, another cycle of injecting hot fluid followed by separation of sand and petroleum should be applied.

In a large deposit, a plurality of wells will ordinarily be utilized, and the above described process may be applied simultaneously or sequentially to a plurality of wells completed in this same formation. As the cavity expands, well to well communication may be established and the process may be changed so as to make use of fluid communication between wells. A substantial area will have been exploited by means of the above described cycling procedure before well to well communication is established however.

The foregoing procedure may be applied to a formation having only one flow path, since the dense, petroleum-insoluble fluid will flow downward to the bottom of the formation and tend to force petroleum upward.

FIELD EXAMPLE

A tar sand deposit is located under a overburden whose thickness is 250 feet. The tar sand deposit is 75 feet thick. The petroleum present in the formation is so viscous that it is totally immobile at formation temperatures. The sand which comprises approximately 60 percent of the volume of the formation, is unconsolidated and only partially in grain-to-grain contact. A well is drilled to the bottom of the formation and casing set through the entire intervals.

Perforations are formed about midway between the top of the formation and the center of the formation, and another set of perforations are formed approximately ten feet from the bottom of the formation. A tubing string is run into the casing, the end of the tubing string being positioned approximately even with the lower set of perforations. A packer is set above the end of the tubing string between the sets of perforations, to isolate the annular space between the tubing string and the casing.

Air is injected into the upper perforations, and the tubing string which is in fluid communication with the lower perforations is open to the atmosphere initially in order to establish some fluid permeability since the initial permeability of the tarsand deposit is found to be exceedingly low. Air injection is continued for at least 24 hours, after which steam is injected into the upper performation with the tubing string open to the atmosphere until it is determined that steam is flowing from the tubing string to the atmosphere. The tubing string is then connected with the steam source and steam is injected into both the upper and lower perforations simultaneously. The steam quality is 80 percent the maximum steam temperature is approximately 366° F (186° C). The injection pressure gradually rises and the injection rate is curtailed when the bottom hole pressure approaches about 150 pounds per square inch gauge, since this is the predetermined maximum safe injection pressure. The injection flow rate is gradually reduced and only enough steam is injected to maintain the bottom hole pressure at about 150 psig for the duration of the soak period during which time heat transfer from the injected steam to the petroleum and mineral matrix is accomplished with sand settling to the lower portion of the zone adjacent the formation affected by the injected steam at the same time. The soak period is approximately 7–10 days during this first cycle.

In order to facilitate separation of petroleum from the sand and to aid in the settling to a lower portion of an affected zone, an oil field brine is obtained which has a specific gravity of 1.15. Approximatley 1% surfactant is added to the brine in order to reduce the interfacial tension between the brine and the viscous petroleum, which aids in the separation thereof. Since any surfactant used in this process must be stable in the presence of high salinity and high temperature, the surfactant utilized was the ammonium salt of a sulfonated, ethoxylated nonphenol containing six ethoxy groups per molecule. This is effective in the high salinity, high temperature embodiment in which it will be subjected. The brine-surfactant mixture is then heated to a temperature 200° F prior to injecting it into the formation. The hot surfactant-brine mixture is introduced into the lower portion of the formation via the tubing, so it saturates the sand area from the bottom up, displacing the heated viscous petroleum in an upward direction as the brine saturates the sand mass.

The heated viscous petroleum is displaced upward and into the annular space through perforations in the casing in the upper portion of the formation, to the surface of the earth. The end point for this cycle is determined when brine is detected, since it indicates that all of the petroleum which has been mobilized in the first phase of the operation has been displaced into the well. At this point, fluid production is terminated and another cycle of steam injection is initiated.

As the zone in which the oil-saturation has been decreased the permeability has been increased expands with each cycle, a greater amount of heating fluid as well as other fluids injected into the process will be required in each new cycle than did the preceding cycle. This must be considered during the course of operation of the process of my invention, and it also offers a means for monitoring the effectiveness of the process in extending the treated zone outwardly from an injection well.

As the affected zone increases and greater quantities of injected fluid are required to fill up and saturate the effected area in each new cycle before any appreciable heating of the petroleum formation surrounding the affected area will be possible. In a large field in which a number of wells are being treated simultaneously and sequentially using this process, there will be a point reached where the process would be converted to a throughput mode in which steam or other heated fluid is injected into one well to move through a communication zone to a remotely located well, so hot fluid injection in the one well and oil production from another well can continue simultaneously.

If the process of my invention is applied to a formation by means of a number of wells, and the formation dip is appreciable, the development and expansion of the cavity will be updip, so subsequent wells should be located updip from the original wells in order to take advantage of tendency for the cavity to develop preferentially updip from the injection point.

While my invention has been described in terms of a number of illustrative embodiments it is not so limited since many variations of the process of my invention will be apparent to persons skilled in the art of oil recovery without departing from the true spirit and scope of my invention. Similarly while mechanisms and explanations have been offered to explain the benefit resulting from application of the process of my invention, it is not my intention to be bound by any particular theory of operation or explanation of mechanisms involved. It is my desire and intention that my invention be limited and restricted only by those limitations and restrictions as appear in the claims appended hereinafter below.

I claim:

1. A method of recovering viscous petroleum from a subterranean, viscous petroleum-containing permeable formation, said formation containing a mineral matrix which is granular and substantially unconsolidated, including a tar sand deposit, said formation being penetrated by at least one well, said well containing two separate communication paths, the first communication path being between the surface of the earth and a protion of the formation near the bottom thereof, and the second communication path being between the surface and portion of the formation near the top thereof, comprising:

a. introducing a heated fluid into the formation via the first communication path, at a gradually increasing injection pressure to a predetermined value less than the overburden fracturing pressure;

b. maintaining the heated fluid in the formation for a predetermined period of time sufficient to heat the viscous petroleum and allow the unconsolidated granular mineral matrix material to settle toward the bottom of the formation;

c. recovering viscous petroleum which has accumulated above the granular, unconsolidated material which is settled toward the bottom of the formation via the second communication path; and d. repeating the above steps for a plurality of cycles to expand the zone from which petroleum is recovered adjacent the production well.

2. A method as recited in claim 1 wherein the heated fluid is steam.

3. A method as recited in claim 1 comprising the additional step of introducing a fluid into the formation which is immiscible with formation petroleum, the specific gravity of the fluid being greater than the specific gravity of the viscous petroleum.

4. A method as recited in claim 3 wherein the fluid is an aqueous brine.

5. A method as recited in claim 3 wherein the fluid which is immiscible with the formation petroleum is heated prior to injecting it into the formation.

6. A method as recited in claim 3 wherein a surface-tension reducing agent is mixed with the fluid which is immiscible with formation petroleum prior to injection thereof into the formation.

7. A method as recited in claim 6 wherein the surface-tension reducing agent is a sulfonated, ethoxylated, alkyl or alkylaryl compound.

8. A method as recited in claim 1 comprising the additional step of introducing a substance into the formation which is miscible with formation petroleum, having a specific gravity substantially less than the specific gravity of formation petroleum.

9. A method as recited in claim 8 wherein the fluid which is miscible with formation petroleum is an aliphatic hydrocarbon having from 4 to 10 carbon atoms.

10. A method as recited in claim 9 wherein the fluid which is miscible with formation petroleum is introduced into the formation simultaneously with the heating fluid.

11. A method of recovering viscous petroleum from a subterranean, viscous petroleum-containing permeable formation, said formation containing a mineral matrix which is granular and substantially unconsolidated, including a tar sand deposit, said formation being penetrated by at least one well which is in fluid communication with at least a portion of the petroleum formation adjacent the well, comprising:

a. introducing a heated fluid into the formation via the well at a gradually increasing injection pressure to a predetermined value less than the overburden fracturing pressure;
b. maintaining the heated fluid in the formation for a predetermined period of time sufficient to heat the viscous petroleum and allow the unconsolidated granular mineral matrix material to settle toward the bottom of the formation;
c. introducing a fluid into the formation which is immiscible with formation petroleum, the specific gravity of the fluid being greater than the specific gravity of the viscous petroleum to displace heated viscous petroleum upward;
d. recovering heated viscous petroleum which has been displaced above the granular, unconsolidated material which is settled toward the bottom of the formation by the fluid having a specific gravity greater than petroleum; and
e. repeating the above steps for a plurality of cycles to expand the zone from which petroleum is recovered adjacent the production well.

12. A method as recited in claim 11 wherein the heated fluid is steam.

13. A method as recited in claim 11 wherein the well contains two separate communication paths between the surface of the earth and the formation, the first being in fluid communication with a portion of the formation near the bottom thereof and the second being in fluid communication with a portion of the formation near the top thereof, and wherein the heated fluid and the fluid which is immiscible with formation petroleum and greater specific gravity than petroleum are introduced into the formation via the first communication path and petroleum is recovered from the formation via the second communication path.

14. A method as recited in claim 11 wherein the fluid of (c) is an aqueous brine.

15. A method as recited in claim 14 wherein the aqueous brine is heated prior to injecting it into the formation.

16. A method as recited in claim 11 wherein a surface tension reducing agent is mixed with the fluid which is immiscible with formation petroleum prior to injection thereof into the formation.

17. A method as recited in claim 16 wherein the surface tension reducing agent is a sulfonated, ethoxylated, alkyl or alkylaryl compound.

18. A method as recited in claim 11 comprising the additional step of introducing a substance into the formation which is miscible with formation petroleum, having a specific gravity substantially less than the specific gravity of formation petroleum.

19. A method as recited in claim 18 wherein the fluid which is miscible with formation petroleum is an aliphatic hydrocarbon having from 4 to 10 carbon atoms.

20. A method as recited in claim 18 wherein the fluid which is miscible with formation petroleum is introduced into the formation simultaneously with the heated fluid.

* * * * *